US007219514B2

(12) United States Patent
Garnier et al.

(10) Patent No.: US 7,219,514 B2
(45) Date of Patent: May 22, 2007

(54) METHOD FOR SEPARATING AIR BY CRYOGENIC DISTILLATION AND INSTALLATION THEREFOR

(75) Inventors: Emmanuel Garnier, Paris (FR); Frédéric Judas, Chatenay-Malabry (FR); Frédéric Staine, Le Plessis Trevise (FR)

(73) Assignee: L'Air Liquide, Société Anonyme á Directoire et Conseil de Surveillance our l'Etude et l'Exploitation des Procédés Georges Claude, Paris (FR)

( * ) Notice: Subject to any disclaimer, the term of this patent is extended or adjusted under 35 U.S.C. 154(b) by 438 days.

(21) Appl. No.: 10/492,758

(22) PCT Filed: Oct. 8, 2002

(86) PCT No.: PCT/FR02/03420

§ 371 (c)(1),
(2), (4) Date: Apr. 14, 2004

(87) PCT Pub. No.: WO03/033978

PCT Pub. Date: Apr. 24, 2003

(65) Prior Publication Data

US 2004/0244416 A1 Dec. 9, 2004

(30) Foreign Application Priority Data

Oct. 17, 2001 (FR) ..... 01 13362

(51) Int. Cl.
*F25J 3/00* (2006.01)

(52) U.S. Cl. ..... 62/643; 62/646; 62/903

(58) Field of Classification Search ..... 62/643, 62/646, 903

See application file for complete search history.

(56) References Cited

U.S. PATENT DOCUMENTS

| | | | | |
|---|---|---|---|---|
| 4,375,367 | A | 3/1983 | Prentice | |
| 5,146,756 | A | 9/1992 | Lavin | |
| 5,839,296 | A | 11/1998 | Bonaquist et al. | |
| 5,860,296 | A * | 1/1999 | Mostello | 62/643 |
| 6,128,921 | A * | 10/2000 | Guillard et al. | 62/643 |
| 6,339,938 | B1 * | 1/2002 | De Bussy et al. | 62/643 |
| 6,351,969 | B1 * | 3/2002 | Arman et al. | 62/643 |
| 6,484,534 | B2 * | 11/2002 | Tranier | 62/646 |
| 6,499,312 | B1 * | 12/2002 | Bergman et al. | 62/643 |

FOREIGN PATENT DOCUMENTS

| | | |
|---|---|---|
| EP | 0 580 345 A1 | 1/1994 |
| EP | 0 921 367 A | 6/1999 |
| EP | 1 074 805 A1 | 2/2001 |
| EP | 1 099 922 A | 5/2001 |

OTHER PUBLICATIONS

International Search Report for PCT/FR 02/03420.

* cited by examiner

*Primary Examiner*—William C. Doerrler
(74) *Attorney, Agent, or Firm*—Elwood L. Haynes

(57) ABSTRACT

A method and apparatus for separating air by cryogenic distillation. The energy of an air separation installation is increased by reducing the size of the exchangers, and therefore increasing the head losses and the temperature differences in the exchange line, and increasing the temperature difference at the main vaporizer. The size of the distillation column is reduced by minimizing the number of theoretical trays and the number of sections of packing or trays. The size of the refrigerating turbine is also reduced by increasing its intake temperature in order to reduce the output.

16 Claims, 1 Drawing Sheet

METHOD FOR SEPARATING AIR BY CRYOGENIC DISTILLATION AND INSTALLATION THEREFOR

BACKGROUND OF THE INVENTION

1. Field of the Invention

The present invention relates to a process for separating air by cryogenic distillation and to an installation for implementing this process.

2. Related Art

In general, the objective of an engineer creating a process for separating air is to minimize the expenditure of energy.

It is well known to use, for producing oxygen with low energy, a double air separation column which is applied, in particular, on the one hand, so as to minimize the delivery pressure of the air compressor, by reducing the head losses in the exchange line and reducing the temperature difference at the main vaporizer, and, on the other hand, to maximize the oxygen extraction efficiency, by reducing the temperature difference in the exchange line, by choosing a high number of theoretical distillation trays and by installing a sufficient number of sections of structured packings or trays.

Thus, low-pressure columns have four sections of structured packings or trays, including two sections between the bottom of the low-pressure column and an intake for rich liquid, this being an oxygen-enriched liquid taken from the bottom of the medium-pressure column. These two sections are necessary for providing high-performance distillation in the bottom of the low-pressure column. Thus, the medium-pressure columns have four sections of structured packings or trays, including two sections between the liquid air intake and the point of withdrawal of lean liquid.

The purified and compressed air sent to the columns cools in an exchange line comprising which would normally have a volume of more than 200 $m^3$, and therefore with a ratio of the total air volume sent to the exchange line to the volume of the exchange line that would be approximately 2000 $Nm^3/h/m^3$ in the case of the example described below.

The refrigeration required for the distillation is frequently provided by an air stream sent to a blowing turbine that feeds the low-pressure column and/or an air stream sent to a Claude turbine. The ratio of the quantity of air sent to the exchange line to the volume sent to the blowing turbine would normally be between 5/1 and 15/1 in the case of the example described below.

In certain cases when energy is not expensive, or even free, it is profitable to reduce expenditure on equipment, while increasing energy requirements.

It is an object of the present invention to reduce the investment cost of an air separation installation and to increase its energy by reducing the size of the exchangers (and therefore increasing the head losses and the temperature differences in the exchange line, and increasing the temperature difference at the main vaporizer), by reducing the size of the distillation columns (by minimizing the number of theoretical trays and the number of sections of packings or trays) and by reducing the size of the refrigerating turbine (by increasing its intake temperature in order to reduce its output).

SUMMARY OF THE INVENTION

The present invention is a process for separating air by cryogenic distillation using an apparatus comprising a medium-pressure column and a low-pressure column that are thermally coupled, in which a quantity of compressed and purified air is cooled in an exchange line down to a cryogenic temperature and is sent at least partly to the medium-pressure column, oxygen-enriched and nitrogen-enriched streams are sent from the medium-pressure column to the low-pressure column and nitrogen-enriched and oxygen-enriched streams are withdrawn from the low-pressure column, wherein the medium-pressure column operates between 6 and 9 bar absolute and the ratio of the total quantity of air entering the exchange line to the total volume of the exchange line is between 3000 and 6000 $Sm^3/h/m^3$.

BRIEF DESCRIPTION OF THE DRAWING

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
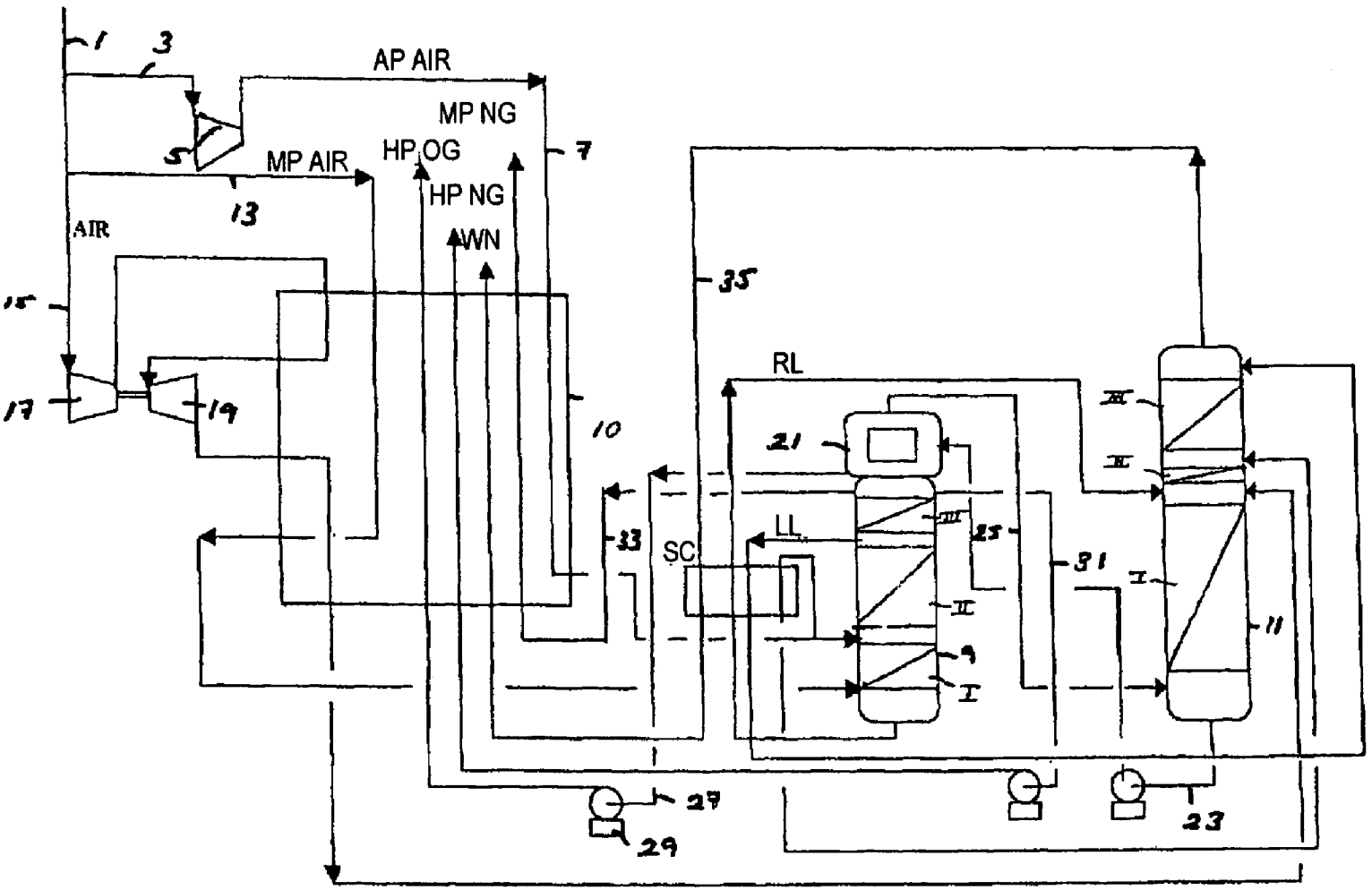
FIG. 1 illustrates a diagram of an installation for implementing the process according to one illustrative embodiment of the present invention.

The quantity of air V sent to the exchange line comprises all the air sent to the distillation unit and the possible streams of air that are expanded and then vented to atmosphere.

A section of structured packings is a section of structured packings between a fluid inlet or outlet.

The structured packings are typically of the cross-corrugated type, but they may have other geometries.

The subject of the present invention is a process for separating air by cryogenic distillation using an apparatus comprising a medium-pressure column and a low-pressure column that are thermally coupled, in which a quantity of compressed and purified air V is cooled in an exchange line down to a cryogenic temperature and is sent at least partly to the medium-pressure column, oxygen-enriched and nitrogen-enriched streams are sent from the medium-pressure column to the low-pressure column and nitrogen-enriched and oxygen-enriched streams are withdrawn from the low-pressure column, characterized in that the medium-pressure column operates between 6 and 9 bar absolute and the ratio of the volumetric flow rate of air entering the exchange line to the total volume of the exchange line is between 3000 and 6000 $Nm^3/h/m^3$.

According to other optional aspects:

- the maximum temperature difference at the cold end of the exchange line is 10° C.;
- the maximum temperature difference at the warm end of the exchange line is 3° C.;
- the maximum temperature difference at the start of liquid oxygen vaporization in the exchange line is 3° C.;
- the maximum temperature difference at the end of liquid oxygen vaporization in the exchange line is 10° C.;
- an oxygen-enriched liquid is sent from the low-pressure column to a sump reboiler where it partially vaporizes by heat exchange with a nitrogen-enriched gas coming from the medium-pressure column, the reboiler having a $\Delta T$ of at least 2.5 K;
- a portion of the compressed and purified air is sent into a blowing turbine, having an inlet temperature of between −50 and −90° C.;
- the ratio of the quantity of air V to the volume of air sent to the blowing turbine is between 20 and 40;

the medium-pressure column contains two or three sections of structured packings and/or the low-pressure column contains three sections of structured packings;

at least one liquid stream is withdrawn from a column, optionally pressurized and vaporized in the exchange line;

the medium-pressure column operates at between 6.5 and 8.5 bar absolute;

the head losses in the exchange line are greater than 200 mbar for a waste nitrogen stream coming from the low-pressure column;

the head losses in the exchange line are greater than 250 mbar for the lower-pressure air stream;

the ratio of the quantity of air V to the volume of air D is between 20/1 and 40/1;

i) a liquid-air expansion turbine is fed by all or part of a stream of liquid air output by the exchange line; and/or ii) a refrigeration set or chilled water produced by a refrigeration set (which may be the same water circuit as that used for cooling the air at the inlet of the purification unit) cools the air output by an air supercharger and/or the air at the lowest pressure; and/or iii) an increased ratio of air is sent to the blowing turbine in such a way that the ratio of the quantity of air V sent to the exchange line to the volume of air D sent to the blowing turbine is less than 20/1;

the purity of the oxygen is between 85 and 100%, preferably between 95 and 100%.

the oxygen extraction efficiency is between 85 and 100%

The subject of the invention is also an air separation installation for producing air gases using a process described above, comprising the medium-pressure column containing two or three sections of structured packings and/or the low-pressure column containing three sections of structured packings.

Optionally, the installation may include an argon column fed from the low-pressure column.

A blowing turbine expands air and sends at least one portion thereof to the low-pressure column of a double column.

The invention will now be described with reference to the figure, which is a diagram of an installation for implementing the process according to the invention.

A 475,000 $Nm^3/h$ stream 1 at 7 bar absolute, coming from a purification unit (not illustrated), is divided into three. A first stream 3 is supercharged in the supercharger 5 up to the pressure required to vaporize the liquid oxygen for example. The high-pressure air HP AIR 7 is sent to the exchange line 10 but does not reach the cold end, being cooled down to −160° C., expanded, liquefied and sent to the two columns 9 and 11, namely the medium-pressure column and the low-pressure column, respectively, of an air separation double column.

A second, non-supercharged, stream MP AIR 13 is also sent to the exchange line 10, through which it partly flows until reaching −140° C. before being sent to the bottom of the medium-pressure column 9.

A 20,000 $Nm^3/h$ third stream 15 is sent to a supercharger 17, partly cooled in the exchange line, and is expanded in a blowing turbine 19, with an inlet temperature of −80° C., before being sent to the low-pressure column 11. The ratio of the volume of air sent through the blowing turbine 19 to the quantity of air sent to the exchange line is 24/1.

The head losses in the exchange line 10 are about 300 mbar in the case of the air stream 13 at the lowest pressure and about 250 mbar in the case of the waste nitrogen 35.

The exchange line 10 has a volume of 125 $m^3$, thus the ratio of the quantity of air sent to the exchange line 10 (stream 1 or volume V) to the volume of this exchange line 10 (=number of bodies×total width×total stack×total length) is 3800 $Nm^3/h/m^3$.

The double column is a conventional apparatus except as regards its dimensions and the number of theoretical trays of the columns, since the medium-pressure column contains 40 theoretical trays and the low-pressure column 45 of them, and as regards the temperature difference in the case of the reboiler 21, which is greater than 2.5° C.

Conventionally, oxygen-enriched liquids (rich liquid RL) and nitrogen-enriched liquid (lean liquid LL) are sent from the medium-pressure column to the low-pressure column after subcooling in the exchanger SC and expansion in a valve.

The low-pressure column 11 contains three sections of structured packings, comprising a sump section I between the bottom of the column and the rich liquid intake (which is conjoint with the blown air intake), a section II between the rich liquid intake and the liquid air intake and a section III between the liquid air intake and the lean liquid intake.

The medium-pressure column 9 contains three structured packings, comprising a sump section I between the bottom of the column and the liquid air intake, a section II between the liquid air intake and the lean liquid outlet LL and a section III between the lean liquid outlet LL and the medium-pressure nitrogen outlet 31. Of course, if there is no withdrawal of liquid nitrogen or gaseous nitrogen, the medium-pressure column contains only two sections, section III being omitted.

The sump reboiler 21 of the low-pressure column 11 is in fact incorporated with the medium-pressure column 9 and is warmed by a stream of medium-pressure nitrogen of this column 9. A stream of liquid oxygen 23 coming from the bottom of the low-pressure column 11 is pumped in order to overcome the hydrostatic head and arrives in the reboiler 21 where it partially vaporizes, a gas stream 25 being sent back to the low-pressure column below the exchange means I and a liquid stream 27 being sent to the pump 29, where it is pressurized up to its use pressure.

The pumped stream 27 vaporizes in the exchange line 10.

A stream of liquid nitrogen 31 is withdrawn as top product from the medium-pressure column 9 above section III, pumped and also vaporizes in the exchange line 10.

The pressure of the liquid nitrogen and the pressure of the liquid oxygen may take any value, provided that the exchange line 10 is designed according to the maximum pressure of the air required for vaporization.

It will be understood that the invention also applies to the case in which a single stream of liquid vaporizes in the exchange line 10, or no liquid withdrawn from a column vaporizes in the installation.

Instead of vaporizing against air, the stream or streams of liquid may vaporize against a stream of cycle nitrogen.

Alternatively, the liquid stream or streams may vaporize in a dedicated exchanger serving only to vaporize the liquid stream or streams against a stream of air or a stream of cycle nitrogen.

The process may also produce liquid oxygen and/or liquid nitrogen and/or liquid argon as final product(s).

Gaseous nitrogen 33, 35 may be withdrawn from the medium-pressure column 9 and/or from the low-pressure column 11.

The gaseous nitrogen 35 warms in the subcooler SC.

Alternatively or in addition, a stream of gaseous oxygen (not illustrated) may be withdrawn as final product from the low-pressure column 11. Optionally, this stream may be pressurized in a compressor.

A stream of medium-pressure gaseous nitrogen MP NG 33 and a stream of low-pressure waste nitrogen 35 are warmed in the exchange line 10. The stream WN may serve to regenerate the air purification system in a known manner and/or may be sent to a gas turbine.

A process as described is used to produce 99.5% pure oxygen HP OG with a yield of more than 97%. This oxygen serves typically in a gasifier supplied with a fuel such as natural gas.

In the installation, the low-pressure column 11 may be alongside the medium-pressure column 9, as in the example, or else above the latter.

To produce a stream of liquid oxygen and/or liquid nitrogen and/or liquid argon and/or to reduce the pressure levels, especially the pressure of the HP AIR 7, the refrigeration required may be provided by using:

i) a liquid-air expansion turbine fed completely or partly with the liquid air stream HP 7 output by the exchanger (10); and/or ii) a refrigeration set or chilled water produced by a refrigeration set (which may be the same water circuit as that used for cooling the air at the inlet of the purification unit) in order to cool air output by the air supercharger 5 and/or the air output by the supercharger 17 and/or the MP 13; and/or iii) by sending an increased ratio of air to the blowing turbine 19 in such a way that the ratio of the quantity of air V sent to the exchange line to the volume of air D sent to the blowing turbine is less than 20/1.

These means for generating refrigeration may also be employed in the case in which no liquid is produced.

The superchargers 5, 17 and/or the main compressor (not illustrated) may be driven by electricity, by a steam turbine and/or by a gas turbine.

The turbine 19 may have a dedicated supercharger or a generator.

The installation may also include conventional components, such as a Claude turbine, a hydraulic turbine, a medium-pressure or low-pressure nitrogen turbine, one or more argon production columns, a mixing column fed with air and oxygen from the low-pressure column, a column operating at an intermediate pressure, for example one fed with the rich liquid and/or with air, a double-reboiler or triple-reboiler low-pressure column, etc.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A process for separating air by cryogenic distillation comprising:

a) coupling a medium-pressure column and a low-pressure column, wherein said medium-pressure column operates between about 6 and about 9 bar absolute;

b) cooling a quantity of compressed and purified air in an exchange line down to a cryogenic temperature, wherein the ratio of the volumetric flow rate of air entering the exchange line to the total volume of the exchange line is between 3000 and 6000 $Nm^3/h/m^3$;

c) sending at least part of the cooled air to the medium-pressure column;

d) sending oxygen-enriched and nitrogen-enriched streams from the medium-pressure column to the low-pressure column; and e) withdrawing nitrogen-enriched and oxygen-enriched streams from the low-pressure column.

2. The process as claimed in claim 1, wherein an oxygen-enriched liquid is sent from the low-pressure column to a sump reboiler where it partially vaporizes by heat exchange with a nitrogen-enriched gas coming from the medium-pressure column, the reboiler having a temperature differential of at least 2.5° C.

3. A process for separating air by cryogenic distillation comprising:

a) coupling a medium-pressure column and a low-pressure column, wherein said medium-pressure column operates between about 6 and about 9 bar absolute;

b) cooling a quantity of compressed and purified air in an exchange line down to a cryogenic temperature, wherein the ratio of the volumetric flow rate of air entering the exchange line to the total volume of the exchange line is between 3000 and 6000 $Nm^3/h/m^3$;

c) sending at least part of the cooled air to the medium-pressure column;

d) sending oxygen-enriched and nitrogen-enriched streams from the medium-pressure column to the low-pressure column; and e) withdrawing nitrogen-enriched and oxygen-enriched streams from the low-pressure column, wherein a portion of the compressed and purified air is sent into a blowing turbine, having an inlet temperature of between about −50 and about −90° C.

4. The process as claimed in claim 3, wherein the ratio of the volume of said compressed and purified air to the volume of said air sent to the blowing turbine is between about 20:1 and about 40:1.

5. The process as claimed in claim 1, wherein the medium-pressure column contains two sections of structured packings.

6. The process as claimed in claim 1, wherein the medium-pressure column contains three sections of structured packings.

7. The process as claimed in claim 5, wherein the low-pressure column contains three sections of structured packings.

8. The process as claimed in claim 1, wherein at least one liquid stream is withdrawn from at least one of the medium-pressure column and the low-pressure column and vaporized.

9. The process as claimed in claim 1, wherein the medium-pressure column operates between about 6.5 and about 8.5 bar absolute.

10. A process for separating air by cryogenic distillation comprising:

a) coupling a medium-pressure column and a low-pressure column, wherein said medium-pressure column operates between about 6 and about 9 bar absolute;

b) cooling a quantity of compressed and purified air in an exchange line down to a cryogenic temperature, wherein the ratio of the volumetric flow rate of air entering the exchange line to the total volume of the exchange line is between 3000 and 6000 $Nm^3/h/m^3$;

c) sending at least part of the cooled air to the medium-pressure column;

d) sending oxygen-enriched and nitrogen-enriched streams from the medium-pressure column to the low-pressure column; and e) withdrawing nitrogen-enriched and oxygen-enriched streams from the low-pressure column, wherein the head losses in the exchange line are greater than about 200 mbar for a waste nitrogen stream coming from the low-pressure column.

11. The process as claimed in claim 3, further comprising:

a) feeding a liquid-air expansion turbine by all or part of a stream of liquid air output by the exchange line;

b) cooling the air output by an air supercharger and the air at the lowest pressure with a refrigeration set or chilled water produced by a refrigeration; and c) increasing the ratio of air sent to the blowing turbine in such a way that the ratio of the quantity of air sent to the exchange line to the volume of air sent to the blowing turbine is less than about 20:1.

12. The process as claimed in claim 1, wherein the purity of the oxygen is between about 85 and about 100%.

13. The process as claimed in claim 12, wherein the purity of the oxygen is between about 95 and about 100%.

14. The process as claimed in claim 1, wherein the oxygen extraction efficiency is between about 85 and about 100%.

15. An air separation installation apparatus for producing air gases using a process as claimed in claim 1, comprising the medium-pressure column containing two or three sections of structured packings and the low-pressure column containing three sections of structured packings.

16. The installation as claimed in claim 15, further comprising an argon column fed from the low-pressure column.

* * * * *